United States Patent [19]

Santén et al.

[11] Patent Number: 4,508,040

[45] Date of Patent: Apr. 2, 1985

[54] METHOD AND PLANT FOR CONVERSION OF WASTE MATERIAL TO STABLE FINAL PRODUCTS

[75] Inventors: Sven Santén; Jan Thörnblom, both of Hofors, Sweden

[73] Assignee: SKF Steel Engineering Aktiebolag, Sweden

[21] Appl. No.: 404,404

[22] Filed: Aug. 2, 1982

[30] Foreign Application Priority Data

Jan. 18, 1982 [SE] Sweden ..... 8200228

[51] Int. Cl.[3] ..... F23D 1/00; C07C 31/04

[52] U.S. Cl. ..... 110/347; 110/345; 75/10 R; 422/186

[58] Field of Search ..... 373/18, 22, 24; 110/235, 237, 238, 242, 250, 254, 341, 346, 347, 345; 423/210 C; 422/186, 186.21, 186.23; 219/121 P, 121 PA, 121 PP, 121 PY

[56] References Cited

U.S. PATENT DOCUMENTS 4,228,747 10/1980 Smirlock et al. ..... 110/347
4,339,546 7/1982 Randalls ..... 422/186 X
4,340,420 7/1982 Santen et al. ..... 75/10 R

*Primary Examiner*—Henry C. Yuen
*Attorney, Agent, or Firm*—Brumbaugh, Graves, Donohue & Raymond

[57] ABSTRACT

The invention relates to a method and plant for converting waste material containing and/or comprising thermally disintegratable chemical substances to stable final products such as $CO_2$, $H_2O$ and HCl, the waste material being subjected to a plasma gas of high temperature generated in a plasma generator in order to effect disintegration.

The waste material in feedable form is caused to flow through a reaction zone, heated by a plasma gas to at least 2000° C. The reaction zone comprises a cavity burned in a gas-permeable filling in piece form arranged in a reaction chamber, by means of the plasma jet from the plasma generator directed towards and projecting into said filling. An appropriate oxygen potential is maintained in at least the reaction zone such that the disintegration products are continuously converted to stable final products.

16 Claims, 1 Drawing Figure

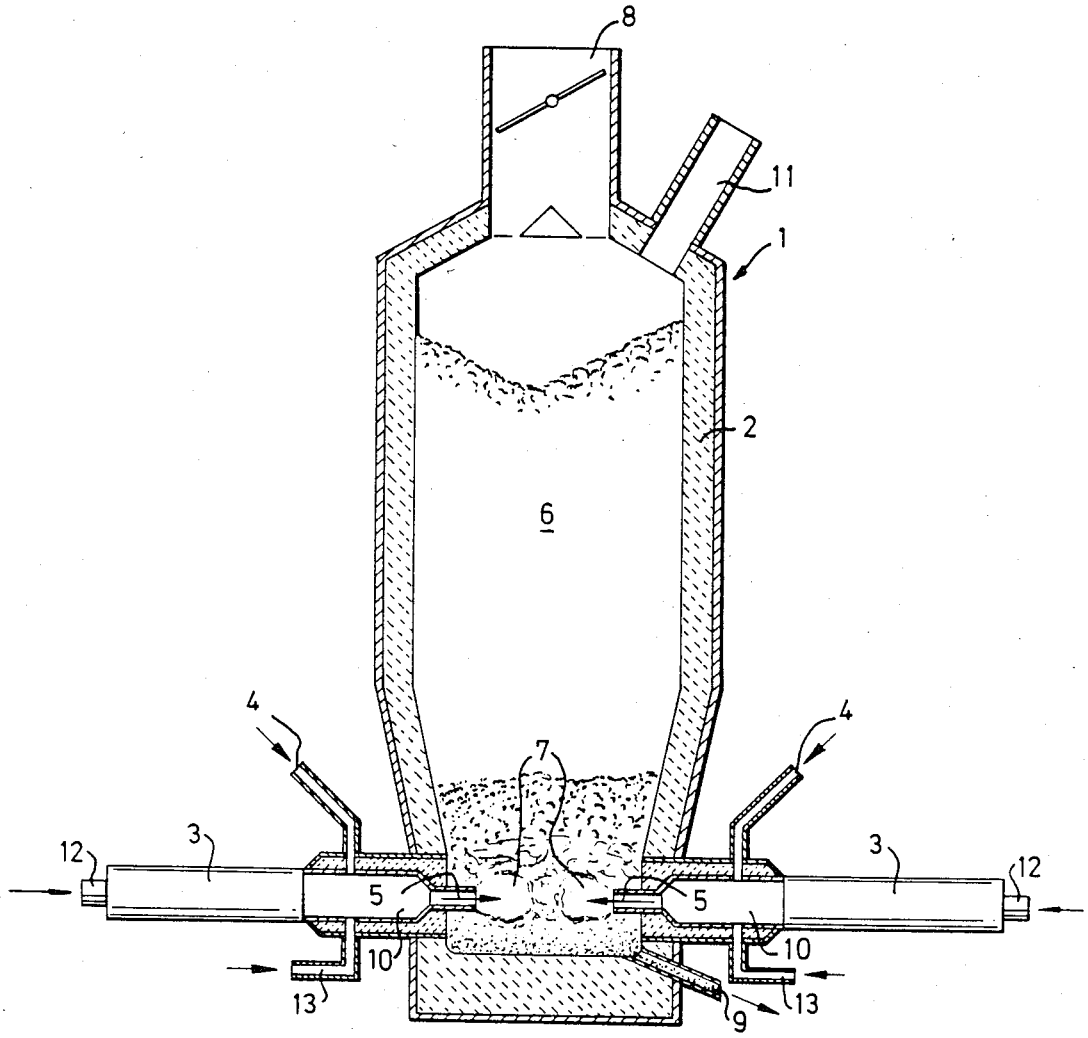
8
11
1
2
6
4
4
7
3
3
12
12
5
5
10
10
13
13
9

METHOD AND PLANT FOR CONVERSION OF WASTE MATERIAL TO STABLE FINAL PRODUCTS

BACKGROUND OF THE INVENTION

1. Field of the Invention

The invention relates to a method of converting waste material, containing and/or comprising thermally disintegratable chemical substances, to stable final products such as $CO_2$, $H_2O$ and HCl, by subjecting the waste material to a plasma gas of high temperature generated in a plasma generator in order to effect disintegration. The invention also relates to a plant for carrying out such a method.

2. Description of the Prior Art

The proposal has already been made to burn waste material in a reaction furnace provided with a reaction hearth and a plurality of plasma burners arranged above the hearth, the plasma gas produced by the plasma burner being collected and directed in the form of a jet towards the waste material in the hearth. The waste material is thus mechanically disintegrated, although not to particle form, and remains in the hearth under the influence of the plasma gas. Stable final products thus obtained can be withdrawn in molten or gaseous form. The task of the plasma burners is to produce the requisite high temperatures. Considered as a whole, such reactions can be controlled only to an extremely limited extent. Furthermore, the individual volume elements of the waste are not in a homogenous thermodynamic environment. All this means that a defined generation of stable final products cannot be assumed in this known method.

SUMMARY OF THE INVENTION

The object of the present invention is to control the method described in the introduction in such a way that the entire reactions can be controlled in order to ensure the desired generation of stable final products. Another. object of the invention is to provide a plant to enable the method according to the invention to be performed simply and functionally.

Accordingly the present invention provides a method of converting waste material containing and/or comprising thermally disintegratable chemical substances to stable final products such as $CO_2$, $H_2O$ and HCl. The waste material to be treated is passed in feedable form through a reaction zone heated to at least 2000° C. Said reaction zone consists of a cavity in a gas-permeable filling material in piece form arranged in a reaction chamber, said cavity being formed by directing the plasma jet from a plasma generator towards and projecting into said filling material. An oxygen potential is maintained in at least the reaction zone such that the disintegration products are continuously converted to stable final products, the waste material being subjected to a plasma gas of high temperature generated in the plasma generator, in order to effect disintegration.

The invention demands that the reaction temperature, the reaction times and oxidation potential must also be carefully controlled in order to achieve a defined generation of stable final products. There is a relation between the reaction temperature and reaction time, such that the time required decreases with increasing reaction temperature, and vice versa. A defined disintegration may be primarily ensured by adjusting the reaction temperature and time at low oxidation potential. Adjustment of the reaction temperature is achieved by suitable setting of the plasma burner. The reaction time can be controlled by arranging a prereaction chamber between the tuyere for the supply of waste material and the main reaction chamber. Only after the defined disintegration is the reaction continued, again at defined oxygen potential through the addition of oxygen, to give stable final products. The reaction time can be varied here by different manipulation of the flow path. Both during the disintegration stage and during continuance of the reaction to stable final products, it is extremely advantageous if the waste material can be supplied in finely disintegrated form. This provides a large ratio of surface area to volume and particularly good reaction ability for the individual parts in the waste material. In addition, both during disintegration and in the subsequent reaction, practically all these individual parts will be in the same thermodynamic environment as regards pressure, temperature and reaction constituents. "Finely disintegrated form" implies that the waste material is in such a form that it can be transported, i.e. it is in feedable form and can be fed into the tuyere or into the reaction zone.

BRIEF DESCRIPTION OF THE DRAWING

In order that the invention will more readily be understood the following description is given, merely by way of example, with reference to an embodiment shown in the accompanying drawing in which the sole FIGURE illustrates a plant intended for converting waste material containing and/or consisting of thermally disintegratable chemical substances. Specifically, it may be used for combustion of plastic materials. The desired stable final products may, for instance, constitute $CO_2$, $H_2O$ and HCl.

DESCRIPTION OF THE PREFERRED EMBODIMENTS

The apparatus according to the invention comprises principally a combustion or reaction chamber 1 with a refractory lining 2, at least on plasma burner 3 (in this case two), and a means 4 for the supply of waste material to be converted. The plasma burners 3 are preferably each of the type utilizing two cylindrical electrodes with an intermediate annular gap through which the plasma gas enters. The plasma gas is heated in the electric arc generated across the annular gap between the electrodes.

Plasma gas is supplied along the inlet pipes 12 and the plasma gas jets 5 leaving the burners 3 enter the reaction chamber 1. The gaseous reaction product formed flow upwardly through the reaction chamber and out through a gas outlet 11. The reaction chamber 1 contains a filling 6, preferably coke, loose enough to permit gas to pass through it. The plasma gas jet 5 feeds the waste material, and/or reaction products from the waste material, into the reaction chamber 1. In the example shown, the coke filling 6 consists of a column of coarse coke pieces. Within the area where each plasma gas jet 5 enters, during the process, a burnt-out cavity 7 is produced which constitutes the reaction zone where conversion to stable final products occurs. Besides, the reaction chamber 1 is in this preferred example a shaft furnace having a blast furnace top 8 for the supply of coke, and a slag outlet 9 at the bottom. Each plasma generator has a pre-reaction chamber 10 arranged upstream of the reaction chamber. In this pre-treatment chamber the plasma gas and the waste material and/or its disintegration products are subjected to intense turbulence.

As shown in the FIGURE, by feeding the carbonaceous material in piece form into the reaction chamber, through a blast furnace top in such a way that the material arrives at the edges of the chamber, the limiting surface of the material in the upper part of the chamber will form a conical crater in accordance with the natural bosh angle of the material, i.e. with thickness of material decreasing upwardly; the layer of material will cover the inner wall surface of the chamber. The distribution of the chunky material thus obtained at the upper portion of the chamber promotes a central gas flow inside the filling and out through the gas outlet, while at the same time enabling a considerable reduction in thermal stress on the blast furnace top and the chamber lining. Furthermore, a substantially constant flow of gas is achieved inside the entire reaction chamber, which is of great importance to achieve uniform thermodynamic conditions for all the material participating in the reaction processes.

The waste material is thus fed through supply means 4 into the tuyere which is arranged immediately downstream of the plasma generator. In the embodiment shown the main tuyere defining the plasma jet 5 is made integrally with the pre-reaction chamber 10. Oxygen can be supplied as well upstream as downstream of the pre-reaction chamber 10, e.g. as shown at 13 in the drawing. A second downstream tuyere (not shown) may be arranged after the integral pre-reaction chamber/tuyere 10.

The method according to the invention can be varied in several respects. For instance, some of the oxygen required for stabilizing the disintegration products can be mixed with the carrier gas and/or plasma gas. In particular, the oxygen can be mixed in a heated state with both the carrier or plasma gas and its disintegration products. If extremely high temperatures are required, the oxygen can be introduced in the form of a plasma gas flow with a temperature of from 2000° C. to 4000° C. The oxygen can be supplied in the form of air and/or in the form of oxygen-enriched air or even practically pure oxygen. However, water can also be used as oxygen carrier since water in the plasma gas dissociates to oxygen and hydrogen due to the high temperature.

Within the scope of the invention waste material in feedable form can be supplied completely or partially to the plasma gas downstream of the plasma burner. In the case of waste material such as dioxines, PCB, and oil-polluted earth, reproducible results are obtained by working with reaction times of the order of milliseconds, and the carrier gas or the plasma gas formed is suitably subjected to turbulence or guided in a suitable circuit in the plasma burner and in the reaction chamber. The gas with the stable final products may be cooled either as it leaves the reaction chamber or afterwards.

If the waste material is in solid and/or liquid form it can be introduced into the plasma gas, in this case in a tuyere arranged immediately upstream of the plasma generator.

Gaseous material is preferably completely or partially fed through the plasma generator.

However, all or part of the waste material may be added in the reaction zone.

The invention also provides apparatus for converting waste material containing and/or comprising thermally disintegratable chemical substances to stable final products, comprising a reaction chamber having a refractory lining, at least one plasma generator, means for the supply of waste material, and a tuyere arranged immediately downstream of the plasma generator, wherein the reaction chamber is provided with a gas-permeable filling in piece form, and the plasma generator is so arranged in relation to the reaction chamber that a cavity, constituting the reaction zone, is in use of the apparatus burnt in the filling by the plasma jet projecting from said plasma generator.

The plasma gas jet from the burner is thus projected into the reaction chamber and the gaseous reaction products can be removed from the reaction chamber. The supply means for waste material, as well as a supply means for oxygen, may open into said tuyere.

In a preferred embodiment of the invention the filling in piece form consists of carbonaceous material, preferably coarse pieces of coke. It is then advisable to locate the reaction chamber in a shaft furnace with (a) a blast furnace top for the supply of the carbonaceous filling material, and (b) a lower slag outlet. This enables the consumed filling material to be continuously replaced via the blast furnace top, as is normal in shaft furnaces. Naturally, the gaseous reaction products extracted are generally subjected to a subsequent treatment, for instance, cooling and/or dust filtration.

The invention demands that the reactions required for converting the waste material to stable final products must be performed under well-defined thermodynamic conditions, i.e. at specific temperature, specific pressure and specific reaction potentials, especially as regards the oxygen potential. There must be a certain excess of oxygen, for instance, until the reactions have progressed to the stable final products, but at the same time, the formation of disturbing chemical compounds must be prevented. It has now surprisingly been found that this problem can be solved by means of the invention, since the coke filling in the combustion chamber quickly uses up the excess oxygen. The coke filling can also be used to produce a reducing atmosphere for the reactions.

The coke filling stabilizes the conversion reactions. The plasma gas flow is adjusted with respect to temperature and composition, in accordance with the operating conditions existing, and thus with respect to the waste material in question. The waste material can be mixed, for instance, in finely disintegrated form in a carrier gas flow which is converted into the plasma gas flow in the burner, its oxygen potential being insufficient for combustion of the waste material or of the disintegration products of the waste material, so that the waste material is first disintegrated in the plasma gas and thereafter further treated by the addition of oxygen. However, oxygen may even be introduced with the carrier gas. The disintegration can take place at a temperature of from 2000° C. to 4000° C., and even after that the high temperatures are still available. Due to certain circumstances, it may be advisable to arrange a pre-reaction chamber upstream of the reaction chamber, for instance in the form of a turbulence chamber in which the oxygen is supplied.

The advantages obtained according to the invention are that the reaction can be carried out under very good control and that generation of stable final products can thus be ensured. The method according to the invention is suitable for the most widely differing types of waste material containing or consisting of thermally disintegratable chemical substances and also waste material which is incombustible or difficult to burn. The fact that the process can be performed in simple equipment, thus ensuring reliable functioning, is a particular advantage.

EXAMPLE 1

In a test run using the method according to the invention, in a plant in accordance with the drawing, 37 kg of 10% solution of pentachlorophenol in an organic solvent was degraded. In the experiment air was used as plasma gas and the temperature of gas leaving the plasma burner was regulated to about 2500° C. After heating the experimental apparatus to operating temperature, i.e. to about 2000° C., the pentachlorophenol solution was fed into the tuyere at a rate of 1.3 kg/min. The plasma generator power was regulated to 460 kW. Compressed air is used as plasma gas and the plasma gas flow rate was 1.8 $m^3$(n)min. 1.2 $M^3$(n) oxygen gas was added per minute in the tuyere upstream of the plasma burner. The disintegration of the pentachlorophenol occurs when it is exposed to the high temperature of the plasma gas and a complete disintegration is achieved in the hot coke grid in the cavity 7 in front of the tuyere. Immediately after disintegration, and primarily in the cavity 7 formed in the coke filling in front of the tuyere, the entire quantity of the hydrogen is bound by the oxygen in the plasma gas and in the oxygen gas supplied. The gas leaving the coke shaft via the outlet 11 still has a temperature of about 1900° C. and is quenched and washed in a caustic soda solution to bind the chlorine and any hydrocarbon. The gas leaving the wash consists of a mixture of carbon monoxide, hydrogen and nitrogen with about 4% carbon dioxide. Analysis was unable to detect pentachlorophenol either in the washing solution or in the exhaust gas. The total quantity of gas leaving the shaft was measured to be 8 $m^3$(n)/min. Analysis of the washed gas gave 36% CO, 4% $CO_2$, 42% hydrogen gas and the remainder mainly nitrogen gas. The total coke consumption during the experiment was about 2.5 kg and a certain quantity of slag could be found in the bottom of the furnace. The quantity of chlorine bound in the washing liquid was 2.45 kg.

EXAMPLE 2

In a test run, using the method in accordance with the invention, sand impregnated with transformer oil containing chlorinated hydrocarbon was degraded. The total sample weighed 60 kg and contained 6.2 kg oil with 2% (about 125 g) chlorinated hydrocarbon. During the experiment air was used as plasma gas and the temperature of the gas leaving the plasma burner was regulated to about 2500° C. The polluted sand was mixed with 55 kg quicklime (to adjust the melting point and buoyancy of the slag formed) and was injected, with the aid of air as carrier gas, into the plasma gas at its exit from the burner. The reactants were carried by the plasma gas into the reaction shaft which contained a filling of coke in piece form (40–60 mm). Prior to the experiment, the reaction chamber was heated to operating temperature (about 2000° C.) The feed rate was 2 kg/min and the quantity of carrier gas 0.6 $m^3$(n)/min. The plasma burner power was regulated to 540 kW and the plasma quantity was 1.8 $m^3$(n)/min. The transformer oil and chlorinated hydrocarbons were disintegrated to carbon (soot), hydrogen and chlorine, which immediately reacted with the oxygen in the air to form carbon monoxide and a small quantity of water vapour. At the same time the sand turned into slag due to the influence of the quicklime, giving CaO, $SiO_2$ slag which was removed at 9 from the lower part of the shaft. The gas, comprising $CO_2$, $H_{22}$, $H_2O$ and $Cl_2$/HCl, leaving the shaft was quenched and washed in caustic soda solution. Analysis was unable to indicate chlorinated hydrogen either in the washing solution, the exhaust or the slag formed. The quantity of chlorine absorbed by the washing solution was 77 g and analysis of the washed gas gave 28% CO, 4% $CO_2$, 7% $H_2$ and the remaining primarily $N_2$. The quantity of coke consumed during the experiment was 4.1 kg and the quantity of slag 117 kg.

The above examples constitute only preferred embodiments. The method according to the invention can also be used for the destruction may be liquid, gaseous or consist of particulate solid material.

Examples of liquid materials are organic solvents, dioxines and biocides, as well as excess solvent from industrial manufacturing processes.

Solid material may, for example, consist of freons or chemical and biological warfare gases.

The starting material should be brought into "feedable" form so solid material may be made suitably by, for instance, being dissolved, suspended or crushed.

Solid material to be fed in with the help of a carrier gas should be disintegrated to a particle size of less than 2 mm. The injection pressure should exceed 2 bar.

When suspended in a liquid, the particles should have a size less than 0.25 mm. In view of the risk of poisoning, suspensions or solutions are to be preferred since these can be prepared in closed systems. With mechanical disintegration it is more difficult to prevent spreading.

Irrespective of whether the supply is in gaseous of liquid form, the injection velocity should preferably exceed 5 m/second, and should more preferably be from 40 to 100 m/second. This also applies for liquids. Injection should preferably be performed in the tuyere upstream of the plasma burner.

If the waste material to be converted is in gaseous form, it is preferably fed through the plasma burner. Of course, it can also be divided so that only part is led through the plasma generator with the plasma gas while the rest is fed into the plasma gas downstream of the generator or directly in the reaction zone. The plasma gas used should preferably consist of gas with a suitable oxygen content for the process—alternatively an extra "oxygen additive" can be controlled by an addition of oxygen to the tuyere or in the reaction zone.

The starting temperature of the plasma gas from the burner should be at least 2000° C. and it should preferably have an energy content such that the temperature in the reaction chamber exceeds 2000° C.

The plasma gas may, for instance, consist of air or circulation gas from the process.

As to localization of the cavity 7, i.e. the reaction zone in the shaft, this appears in front of the plasma generator during the reaction. However, the cavity does not remain intact, but is built only to collapse relatively soon and then be rebuilt again and so on. In principle the cavity consists of the spaces between the pieces of the filling material, these spaces being enlarged as the reaction progresses.

Oxygen may be added in any form, such as water, or water vapour.

Also, the filling material may even contain dolomite or similar substances, such as chalk, to bind sulphur.

The carbonaceous material is preferably coke in piece form, suitably larger than 20 mm, preferably from 40 to 60 mm.

The material should preferably remain in the actual cavity for several milliseconds, and in the remaining column of coke for from about 1 to 5 seconds.

However these durations of stay, suitable in certain cases, can be regulated in many ways, such as by suitable adjustment of the feed rate.

If desired for technical reasons, the gas temperature in the upper part of the shaft can be reduced to about 1000° C. by supplying water.

The gas flowing out of the shaft is suitably quenched to ambient temperature.

If necessary a suitable slag-former may be added.

The invention is obviously not limited to the embodiments described above, but can be varied in many ways within the scope of the following claims.

We claim:

1. A method of converting waste material at least partially comprising thermally disintegratable chemical substances to stable final products such as $CO_2$, $H_2O$ and HCl, comprising the steps of:

(a) bringing such waste material as may be present in solid form into feedable form by dissolving, suspending or crushing such material;

(b) at least partially disintegrating the waste material in a plasma gas of high temperature generated in a plasma generator by introducing the plasma gas, with at least one of the waste materials and the disintegration products thereof, into a prereaction chamber between the plasma generator and a reaction chamber, and subjecting said plasma gas and said at least one of said waste material and disintegration products to intense turbulence therein;

(c) thereafter feeding the at least partially disintegrated waste material in feedable form together with an oxygen-containing gas into a reaction zone heated to at least 2000° C., said reaction zone consisting of a cavity in a gas-permeable carbonaceous filling material in piece form arranged in a reaction chamber, said cavity being formed by directing the plasma jet from the plasma generator towards and projecting into said filling material in the reaction chamber;

(d) in said reaction zone maintaining the oxygen potential such that substantially completely all the at least partially converted waste material is converted into stable final products;

(e) removing the stable final products from the reaction zone by permitting gaseous products to flow upwardly through the gas-permeable filling material and molten or soild products to fall into the bottom of the reaction chamber; and (f) binding substantially all of such chlorine and hydrogen chloride as may be contained in said gaseous products by rapid cooling and washing.

2. A method according to claim 1, including introducing the waste material into the plasma gas downstream of the plasma generator.

3. A method according to claim 1, including introducing the waste material into the plasma gas upstream of the plasma generator.

4. A method according to claim 1, wherein the waste material is introduced directly into the reaction zone.

5. A method according to claim 1, wherein the waste material exists at least partially in gaseous form and including the step of at least partially mixing said material with the plasma gas upstream of the plasma generator.

6. A method according to claim 1, including adding the oxygen to the plasma gas at least one of (i) upstream of or (ii) downstream of the plasma generator or (iii) in the reaction zone.

7. A method according to any one of claims 1 to 6, including bringing the waste material present in solid form into feedable form by mechanical crushing and transferring it to at least one of a solution and suspension.

8. A method according to any one of claims 1 to 6, including introducing the waste material by means of a carrier gas, said material having a maximum particle size of 2 mm.

9. A method according to any one of claims 1 to 6, including adding waste material in the form of a liquid containing suspended particles having a maximum particle size of about 0.25 mm.

10. A method according to any one of claims 1 to 6, including introducing the waste material at an injection pressure in excess of 2 bar at the feeding.

11. A method according to any one of claims 1 to 6, including injecting the waste material at an injection velocity greater than 5 m/second.

12. A method according to any one of claims 1 to 6, wherein the plasma gas is a mixture of air and another gas having an oxygen content suitable for converting said waste material to final combustion products.

13. A method according to claim 1, wherein said carbonaceous material comprises coarse pieces of coke.

14. A method according to any one of claims 1 to 6, wherein the filling consists at least partially of at least one of dolomite and another sulphur-binding material.

15. A method according to any one of claims 1 to 6, including maintaining the reactants in the cavity for a period of several milliseconds and in the remainder of the filling for a further period of about 1 to 5 seconds.

16. A method according to any one of claims 1 to 6, including rapidly cooling and washing in a caustic soda solution the gas leaving the reaction chamber to bind chlorine and any hydrogen chloride.

* * * * *